US009359971B2

(12) United States Patent
Donahue et al.

(10) Patent No.: US 9,359,971 B2
(45) Date of Patent: Jun. 7, 2016

(54) SYSTEM FOR CONTROLLING DEPOSITS ON CYLINDER LINER AND PISTON OF RECIPROCATING ENGINE

(71) Applicant: General Electric Company, Schenectady, NY (US)

(72) Inventors: Richard John Donahue, West Bend, WI (US); Mark James Lemke, Sun Prairie, WI (US)

(73) Assignee: General Electric Company, Schenectady, NY (US)

( * ) Notice: Subject to any disclaimer, the term of this patent is extended or adjusted under 35 U.S.C. 154(b) by 112 days.

(21) Appl. No.: 14/465,564

(22) Filed: Aug. 21, 2014

(65) Prior Publication Data

US 2016/0053710 A1 Feb. 25, 2016

(51) Int. Cl.
*F02F 1/00* (2006.01)
*F02F 3/00* (2006.01)

(52) U.S. Cl.
CPC ..... *F02F 1/004* (2013.01); *F02F 3/0076* (2013.01); *F02F 2001/006* (2013.01)

(58) Field of Classification Search
CPC ..... F02F 1/004; F02F 3/00; F02F 3/0076; F02F 2001/006
USPC ..... 123/193.2, 193.6; 29/888.061
See application file for complete search history.

(56) References Cited

U.S. PATENT DOCUMENTS 4,106,463 A 8/1978 Curtis, Jr. et al.
4,196,547 A 4/1980 Keske
4,829,955 A 5/1989 Strasser
5,052,281 A 10/1991 Kawabata et al.
5,884,600 A * 3/1999 Wang et al. ..... 123/193.6
6,164,260 A 12/2000 Bock
6,189,500 B1 2/2001 Gyllenstedt
6,347,575 B1 2/2002 Booher
6,367,463 B1 4/2002 Nurmi
7,089,662 B2 * 8/2006 Izquierdo et al. ..... 29/888.061
7,438,038 B2 10/2008 Azevedo et al.
7,677,217 B2 3/2010 Kumar et al.

(Continued)

FOREIGN PATENT DOCUMENTS

DE 8705785 U1 8/1988
EP 0288096 A2 10/1988

(Continued)

OTHER PUBLICATIONS

European Search Report issued in connection with corresponding EP application No. 15181236.9 on Dec. 22, 2015.

*Primary Examiner* — Marguerite McMahon
(74) *Attorney, Agent, or Firm* — Fletcher Yoder P.C.

(57) ABSTRACT

A system includes a reciprocating engine having a cylinder liner and a piston disposed within the cylinder liner. The cylinder liner includes an inner wall and extends around a cavity. The inner wall includes a first axial end, a second axial end, a piston travel portion, and a top portion. The top portion is nearer to the first axial end of the cylinder liner than to the second axial end of the cylinder liner. The top portion has a first surface finish with a first roughness average ($Ra_1$) greater than approximately 2 μm and a total waviness (Wt) less than approximately 0.1 mm. The piston is configured to move in a reciprocating manner within the cylinder liner. The piston includes a top land configured to be radially opposite the top portion of the inner wall of the cylinder liner when the piston is at a top dead center position.

20 Claims, 3 Drawing Sheets

(56) References Cited

U.S. PATENT DOCUMENTS

| | | | | |
|---|---|---|---|---|
| 8,413,632 | B2 | 4/2013 | Sand | |
| 8,459,175 | B2 | 6/2013 | Blythe et al. | |
| 2003/0192501 | A1* | 10/2003 | Ishikawa et al. | 123/193.2 |
| 2005/0199196 | A1* | 9/2005 | Azevedo et al. | 123/41.84 |
| 2007/0107689 | A1 | 5/2007 | Oogake et al. | |
| 2007/0246026 | A1 | 10/2007 | Azevedo et al. | |
| 2008/0053396 | A1* | 3/2008 | Hiraishi et al. | 123/193.2 |
| 2009/0095248 | A1 | 4/2009 | Kumar et al. | |
| 2013/0234400 | A1* | 9/2013 | Iijima et al. | 277/459 |

FOREIGN PATENT DOCUMENTS

| | | | |
|---|---|---|---|
| EP | 653555 | A1 | 5/1995 |
| EP | 693618 | B1 | 10/1998 |
| EP | 952326 | B1 | 6/2004 |
| EP | 800627 | B1 | 1/2005 |
| EP | 2282084 | A1 | 2/2011 |
| EP | 2096337 | A1 | 8/2011 |

* cited by examiner

SYSTEM FOR CONTROLLING DEPOSITS ON CYLINDER LINER AND PISTON OF RECIPROCATING ENGINE

BACKGROUND

The subject matter disclosed herein relates generally to reciprocating engines, and, more particularly to surface finishes of cylinder liners and pistons of reciprocating engines.

A reciprocating engine (e.g., an internal combustion engine) combusts fuel with an oxidant (e.g., air) to generate hot combustion gases, which in turn drive a piston (e.g., a reciprocating piston) within a cylinder liner. In particular, the hot combustion gases expand and exert a pressure against the piston that linearly moves the piston within the cylinder liner during an expansion stroke (e.g., a down stroke). The piston converts the pressure exerted by the combustion gases and the piston's linear motion into a rotating motion (e.g., via a connecting rod and a crankshaft coupled to the piston) that drives a shaft to rotate one or more loads (e.g., an electrical generator). The design and configuration of the piston and cylinder liner can significantly impact emissions (e.g., nitrogen oxides, carbon monoxide, etc.), as well as oil consumption. Furthermore, the design and configuration of the piston and cylinder liner can significantly affect friction between components of the reciprocating engine and the life of the components of the reciprocating engine. Unfortunately, deposits formed on the piston may increase wear on the cylinder liner or impact emissions.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a reciprocating engine includes a cylinder liner and a piston disposed within a cavity. The cylinder liner includes an inner wall and extends around the cavity. The inner wall includes a first axial end, a second axial end, a piston travel portion, and a top portion. The top portion is nearer to the first axial end of the cylinder liner than to the second axial end of the cylinder liner, the top portion has a first surface finish with a first roughness average ($Ra_1$) greater than approximately 2 μm and a total waviness (Wt) less than approximately 0.1 mm, and $Ra_1$ and Wt are based on a characteristic length of approximately 0.8 mm. The piston is configured to move in a reciprocating manner within the cylinder liner. The piston includes a top land configured to be radially opposite the top portion of the inner wall of the cylinder liner when the piston is at a top dead center position.

In a second embodiment, a system includes a reciprocating engine having a cylinder liner and a piston disposed within a cavity. The cylinder liner includes an inner wall and extends around the cavity. The cylinder liner includes a first radius at a top portion of the inner wall of the cylinder liner, and the top portion includes a first surface finish having a first roughness average ($Ra_1$) and a total waviness (Wt) less than approximately 0.1 mm. The piston is configured to move in a reciprocating manner within the cylinder liner. The piston includes at least one annular groove extending circumferentially about the piston, and a top land adjacent to a top annular groove of the at least one annular groove. The top land includes a second radius and a second surface finish. A radial clearance between the first radius and the second radius during operation of the reciprocating engine is less than approximately 25 μm. The second surface finish has a second roughness average ($Ra_2$) less than approximately 2 μm, and $Ra_2$ is less than $Ra_1$. The $Ra_1$, Wt, and $Ra_2$ are based on a characteristic length of approximately 0.8 mm.

In a third embodiment, a system includes a reciprocating engine having a cylinder liner and a piston disposed within a cavity. The cylinder liner includes an inner wall and extends around the cavity. The inner wall includes a first axial end, a second axial end, a piston travel portion, and a top portion. The cylinder liner includes a first radius at the top portion of the inner wall, and the top portion is nearer to the first axial end of the cylinder liner than to the second axial end of the cylinder liner. The top portion includes a first surface finish, and the first surface finish has a first roughness average ($Ra_1$) greater than approximately 2 μm and a total waviness (Wt) less than approximately 0.1 mm. The piston is configured to move in a reciprocating manner within the cylinder liner. The piston includes a top land configured to be radially opposite the top portion of the inner wall of the cylinder liner when the piston is at a top dead center position. The piston includes a second radius at the top land, and the top land of the piston has a second surface finish having a second roughness average ($Ra_2$) less than $Ra_1$. A radial clearance between the first radius and the second radius during operation of the reciprocating engine is less than approximately 25 μm, and a difference between $Ra_1$ and $Ra_2$ is greater than approximately 0.5 μm. The $Ra_1$, Wt, and $Ra_2$ are based on a characteristic length of approximately 0.8 mm.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
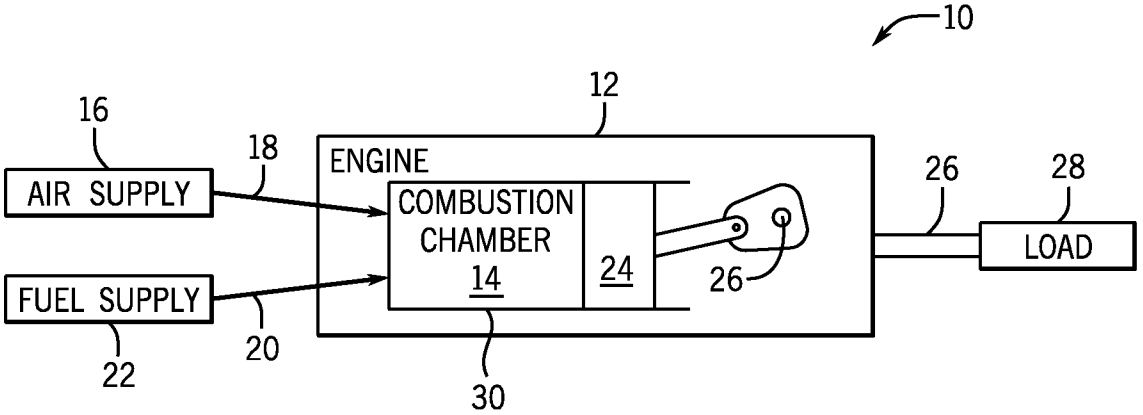
FIG. 1 is a schematic block diagram of an embodiment of a portion of an engine driven power generation system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Reciprocating engines (e.g., internal combustion engines) in accordance with the present disclosure may include one or more piston assemblies, each having a piston configured to move linearly (e.g., axially) within a cylinder liner to convert pressure exerted by combustion gases and the linear motion of the piston into a rotating motion to power one or more loads. A top portion of the cylinder liner may have a surface finish with a roughness average (Ra) greater than approximately 1, 2, 3, 4, 5, 10, or 15 μm and a total waviness (Wt) less than approximately 0.1, 0.05, or 0.03 mm over a characteristic length of approximately 0.8 mm. As may be appreciated, the Ra and Wt may vary with different characteristic lengths (e.g., 0.08, 0.25, 2.5, and 8 mm). Additionally, or in the alternative, a top land of the piston within the cylinder liner may have a surface finish with a roughness average less than approximately 2, 1, 0.8, 0.5, or 0.3 μm. A radial clearance between the top land of the piston and the top portion of the cylinder liner may be less than approximately 25 μm at operating temperature with a clearance ratio less than approximately 0.5% of the bore diameter at room temperature, which may be defined herein as a Tight Top Land (TTL) condition. As utilized herein, the clearance ratio may be defined as the ratio of the top land clearance to the cylinder bore diameter, and the top land clearance may be defined as the difference between the cylinder bore diameter and the piston top land diameter. The greater roughness of the top portion of the cylinder liner relative to the top land of the piston may increase the retention of deposits on the cylinder liner and/or may decrease the retention of deposits on the top land. In some embodiments, retained deposits on the cylinder liner may scrape (e.g., remove) deposits from the top land, thereby reducing the deposits on the top land of the piston. Moreover, the surface finish of the top portion of the cylinder liner may not affect a crevice volume for the piston assembly. For example, whereas a separate anti-polishing ring (e.g., carbon scraper) may increase a crevice volume of the piston assembly and/or increase the quantity of components of the piston assembly, the surface finish of the top portion of the cylinder liner described herein may enable retained deposits on the top portion to function as an anti-polishing ring for the piston. Furthermore, reducing the deposits retained on the top land may reduce wear of the cylinder liner and/or may reduce frictional heating on the piston. Friction between the cylinder liner and the piston from deposits retained on the top land of the piston may cause wear between the top land and the inner wall of the cylinder liner (e.g., carbon raking and bore polishing), thereby increasing oil consumption, increasing blowby of unburned hydrocarbons past seals, or increasing emissions, or any combination thereof. Accordingly, reducing friction between the cylinder liner and the piston by reducing deposits on the top land of the piston may reduce oil consumption, reduce blowby of unburned hydrocarbons between the cylinder liner and the piston, or reduce emissions, or any combination thereof. Advantageously, the surface finish of the top portion of the cylinder liner that retains deposits used to remove deposits from the top land of the piston may not significantly add to the crevice volume of the piston assembly.

Turning to the drawings, FIG. 1 illustrates a block diagram of an embodiment of a portion of an engine driven power generation system 10. As described in detail below, the system 10 includes an engine 12 (e.g., a reciprocating internal combustion engine) having one or more combustion chambers 14 (e.g., 1, 2, 3, 4, 5, 6, 7, 8, 10, 12, 14, 16, 18, 20, or more combustion chambers 14). Each combustion chamber 14 is defined by a cylinder 30 and a piston 24 reciprocating in the cylinder 30. An air supply 16 is configured to provide a pressurized oxidant 18, such as air, oxygen, oxygen-enriched air, oxygen-reduced air, or any combination thereof, to each combustion chamber 14. The combustion chamber 14 is also configured to receive a fuel 20 (e.g., a liquid and/or gaseous fuel) from a fuel supply 22. A mixture (e.g., fuel-air mixture) of the oxidant 18 and the fuel 20 ignites and combusts within each combustion chamber 14. The hot pressurized combustion gases cause a piston 24 adjacent to each combustion chamber 14 to move linearly within the cylinder 30 and convert pressure exerted by the gases into a rotating motion, thereby causing a shaft 26 to rotate. Further, the shaft 26 may be coupled to a load 28, which is powered via rotation of the shaft 26. For example, the load 28 may be any suitable device that may generate power via the rotational output of the system 10, such as an electrical generator. As another example, the load 28 may be a vehicle driven by the engine 12. Additionally, although the following discussion refers to air as the oxidant 18, any suitable oxidant may be used with the disclosed embodiments. Similarly, the fuel 20 may be any suitable fuel, such as natural gas, associated petroleum gas, hydrogen, propane, gasoline, biogas, sewage gas, syngas, landfill gas, coal mine gas, diesel, kerosene, or fuel oil for example.

The system 10 disclosed herein may be adapted for use in stationary applications (e.g., in industrial power generating engines) or in mobile applications (e.g., in automobiles or aircraft). The engine 12 may be a two-stroke engine, three-stroke engine, four-stroke engine, five-stroke engine, or six-stroke engine. In some embodiments, the cylinders 30 may include cylinder liners that are separate from an engine block. For example, steel cylinder liners may be utilized with an aluminum engine block. The engine 12 may also include any number of combustion chambers 14, pistons 24, and associated cylinders 30 or cylinder liners (e.g., 1-24). For example, the system 10 may include a large-scale industrial reciprocating engine having 4, 6, 8, 10, 16, 24 or more pistons 24 reciprocating in cylinders 30. The cylinder liners and/or the pistons 24 may have a diameter of between approximately 10-34 centimeters (cm), 12-20 cm, or about 15 cm. In certain embodiments, the piston 24 may be a steel piston or an aluminum piston with an Ni-resist ring insert in a top ring groove of the piston 24. In some embodiments, the system 10 may generate power ranging from 10 kW to 10 MW. Additionally, or in the alternative, the operating speed of the engine may be less than approximately 1800, 1500, 1200, 1000, 900, 800, or 700 RPM.

Figure 2:
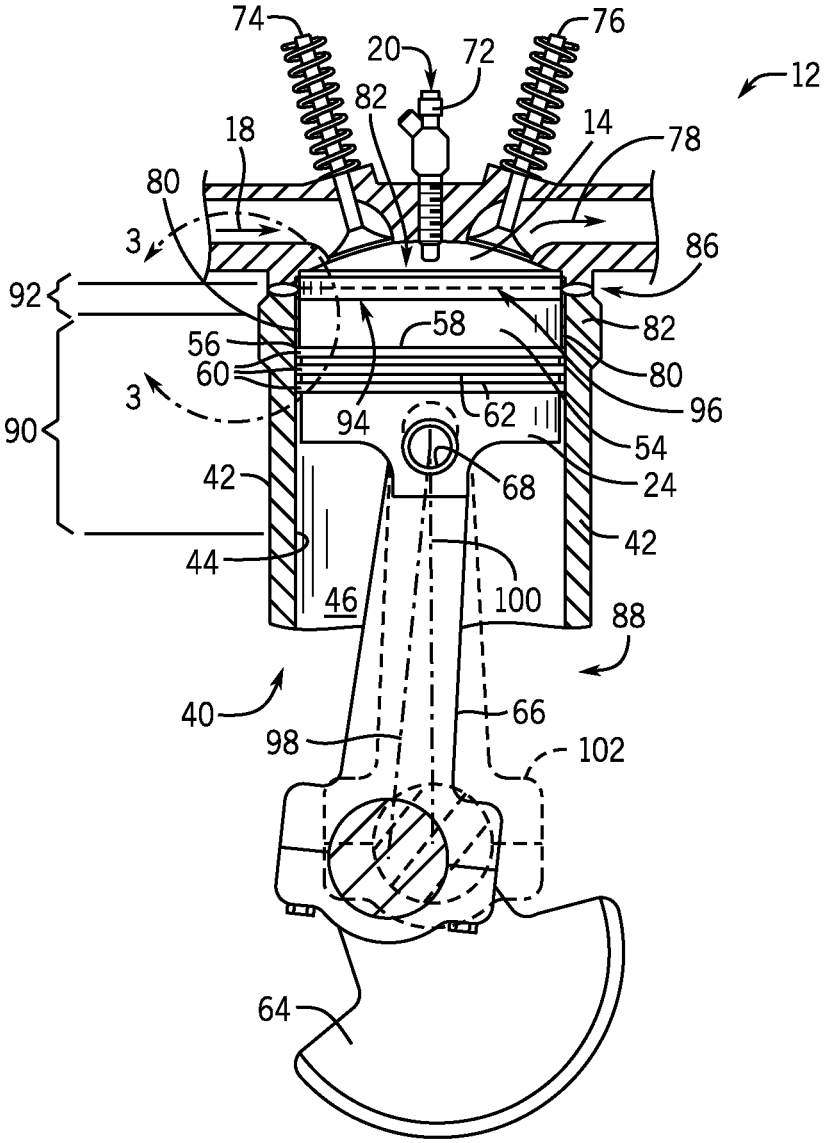
FIG. 2 is a cross-sectional view of an embodiment of a piston positioned within a cylinder liner of an engine.
Figure 2:
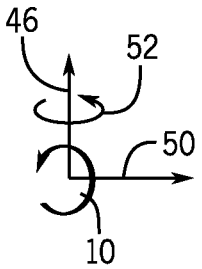

FIG. 2 is a side cross-sectional view of an embodiment of a piston assembly 40 having a piston 24 disposed within a cylinder liner 42 (e.g., an engine cylinder 30) of the reciprocating engine 12. The cylinder liner 42 has an inner annular wall 44 defining a cylindrical cavity 46. Directions relative to the engine 12 may be described with reference to an axial axis or direction 48, a radial axis or direction 50, and a circumferential axis or direction 52. The piston 24 includes a top land 54 and a first annular groove 56 (e.g., a top annular groove or a top annular ring groove) extending circumferentially (e.g., in the circumferential direction 52) about the piston 24. A first annular ring 58 (e.g., a top annular ring or a top piston ring)

may be positioned in the top annular groove 56. The top annular ring 58 may be configured to expand and contract in response to high temperatures and high pressure combustion gases to which the top annular ring 58 is subjected during operation of the system 10. As shown, the piston 24 may include one or more additional annular grooves 60 (e.g., additional annular ring grooves) extending circumferentially about the piston 24 and spaced apart from the top annular groove 56 along the axial axis 48. Additional annular piston rings 62 may be positioned in each of the additional annular grooves 60. It should be understood that the plurality of additional annular grooves 60 and the corresponding additional annular piston rings 62 may have any of a variety of configurations. For example, one or more of the plurality of additional grooves 60 and/or corresponding additional rings 62 may have different configurations, shapes, sizes, and/or functions, for example.

As shown, the piston 24 is attached to a crankshaft 64 via a connecting rod 66 and a pin 68. The crankshaft 64 translates the reciprocating linear motion of the piston 24 along the axial axis 48 into a rotating motion 70. The combustion chamber 14 is positioned adjacent to the top land 54 of the piston 24. One or more fuel injectors 72 provides the fuel 20 to the combustion chamber 14, and one or more valves 74 controls the delivery of air 18 to the combustion chamber 14. An exhaust valve 76 controls discharge of an exhaust gas 78 from the engine 12. However, it should be understood that any suitable elements and/or techniques for providing fuel 20 and air 18 to the combustion chamber 14 and/or for discharging the exhaust gas 78 may be utilized.

In operation, combustion of the fuel 20 with the air 18 in the combustion chamber 14 causes the piston 24 to move in a reciprocating manner (e.g., back and forth) in the axial direction 48 within the cavity 46 of the cylinder liner 42. As the piston 24 moves, the crankshaft 64 rotates to power the load 28 (shown in FIG. 1), as discussed above. A clearance gap 80 (e.g., a radial clearance defining an annular space) is provided between the inner wall 44 of the cylinder liner 42 and an outer surface 82 of the piston 24. The top annular ring 58 and any additional annular rings 62 may contact the inner wall 44 of the cylinder liner 42 to retain the fuel 20, the air 18, and a fuel-air mixture 84 within the combustion chamber 14. Additionally, or in the alternative, the top annular ring 58 and any additional annular rings 62 may facilitate maintenance of a suitable pressure within the combustion chamber 14 to enable the expanding hot combustion gases 78 to cause the piston 24 to move along the axial axis 48. The top annular ring 58 and/or the additional annular rings 62 may distribute a lubricant (e.g., oil) over the inner wall 44 of the cylinder liner 42 to reduce friction and/or to reduce heat generation within the engine 12.

The piston 24 reciprocates along the axial axis 48 between a first axial end 86 and a second axial end 88 of the cylinder liner 42, rotating the crankshaft 64 as shown by arrow 70. The top land 54 of the piston 24 reciprocates through a travel portion 90 of the inner wall 44 of the cylinder liner 42 for most of the reciprocating motion. When the piston 24 is at a top dead center position within the cylinder liner 42, the top land 54 of the piston is radially opposite a top portion 92 of the cylinder liner 42. As may be appreciated, the top dead center position of the piston 24 corresponds to when a top surface 94 of the piston 24 is at an apex 96. In some embodiments, an axis 98 of the connecting rod 66 is substantially aligned with an axis 100 of the cylinder liner 42 at the top dead center position. For example, the piston 24 may be at the top dead center position when the connecting rod 66 is in a position 102 shown by the dashed lines of FIG. 2. As may be appreciated, the volume of the combustion chamber 14 may have a minimum value when the piston 24 is at the top dead center position. The movement of the piston 24 reverses direction along the axial axis 48 at the top dead center position. In some embodiments, the top portion 92 of the cylinder liner 42 includes portions of the inner wall 44 that are radially opposite to the top land 54 when the axis 98 of the connecting rod 66 is within approximately 15 degrees or less, 10 degrees or less, or 5 degrees or less of the axis 100 of the cylinder liner 42. Additionally, or in the alternative, the top portion 92 of the cylinder liner 42 includes portions of the inner wall 44 that are above the top land 54 of the piston 24 when the piston 24 is at the top dead center position. In some embodiments, the diameter of the top portion 92 of the cylinder liner 42 may be substantially equal to the diameter of the travel portion 90 of the cylinder liner 42.

Figure 3:
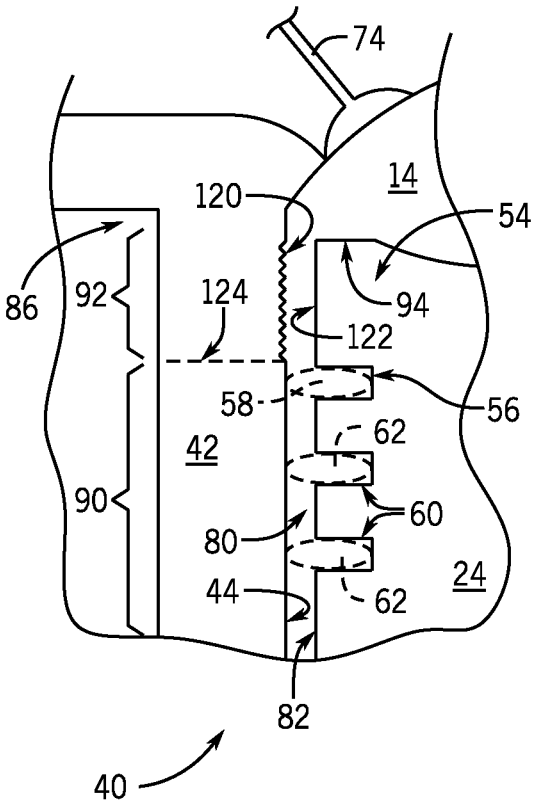
FIG. 3 is a partial cross-sectional view of an embodiment of the piston and the cylinder liner of the engine, taken within line 3-3 of FIG. 2, when the piston is at a top dead center position.

FIG. 3 is a partial cross-sectional view of the piston 24 and cylinder liner 42 of the engine 12, taken within line 3-3 of FIG. 2. FIG. 3 illustrates the piston 24 in the top dead center position 24, in which the top land 54 of the piston 24 is radially opposite the top portion 92 of the cylinder liner 42. The fuel 20 and the air 18 may begin combustion in the combustion chamber 14 prior to or approximately when the piston 24 approaches the top dead center position. Portions of the fuel 20 and the air 18 within the combustion chamber 14 may incompletely react during some combustion cycles of the piston 24. The incomplete products of combustion may contribute to emissions and/or form deposits (e.g., carbon deposits) on the cylinder liner 42 or the piston 24. Additionally, or in the alternative, coked lubricant (e.g., oil) may form carbon deposits on surfaces of the combustion chamber 14, such as the top land 54 of the piston 24 and/or the top portion 92 of the cylinder liner 42. Gaps or crevices near the combustion chamber 14 greater than a certain size may increase a crevice volume of a piston assembly 40. The crevices may retain portions of the exhaust gas 78 or the fuel-air mixture 84 from one piston cycle to another, thereby reducing combustion efficiency. Additionally, or in the alternative, the crevices may retain portions of the fuel 20 or the air 18 during a piston cycle, thereby enabling incomplete reaction during a piston cycle and reducing the combustion efficiency.

Accordingly, the geometry of the piston 24 and the cylinder liner 42 of the piston assembly 40 may have a tight top land (TTL) design, thereby reducing the crevice volume of the piston assembly 40, reducing emissions, and increasing the efficiency of combustion. As defined herein, a TTL design has an operating clearance less than approximately 25 μm radially when the engine 12 operates at rated temperatures (e.g., combustion temperatures between approximately 480° to 815° C., approximately 540° to 760° C., or approximately 590° to 700° C.). For example, the TTL design may have an operating clearance (e.g., gap 80) less than approximately 35, 30, 25, 20, or 15 μm radially between a first surface 120 of the top portion 92 of the cylinder liner 42 and a second surface 122 of the top land 54 of the piston 24 when the engine 12 operates at rated temperatures. In some embodiments, a TTL design of the piston assembly 40 may have a top land radial clearance about the top land 54 of the piston 24 that is between approximately 0.36% to 0.46% of the nominal bore diameter for an aluminum piston when at room temperature (e.g., approximately 20° C.). The top land radial clearance about the top land 54 for a piston of another material (e.g., steel) of the TTL design may be determined by multiplying the top land radial clearance for an aluminum piston by the ratio of the thermal expansion coefficients between the other material (e.g., steel) and aluminum. For example, for steel 42CrMo4V with a thermal expansion coefficient of 13.2

($10^{-6}$ m/m K) and for aluminum M124G with a thermal expansion coefficient of 21 ($10^{-6}$ m/m K), the top radial clearance about the top land 54 for the steel 42CrMo4V piston is between approximately 0.23% to 0.29% of the nominal bore diameter for the steel 42CrMo4V piston. (e.g., 0.36%×(13.2/21)=0.23%; 0.46×(13/21)=0.29%).

Carbon deposits from the exhaust gas 78 or lubricant may form on surfaces about the combustion chamber 14. If carbon deposits form on the second surface 122 of the top land 54, the carbon deposits may increase friction and wear (e.g., carbon raking and bore polishing) on the travel portion 90 of the inner surface 44 of the cylinder liner 42. Wear on the inner surface 44 of the cylinder liner 42 may increase oil consumption via increasing the gap 80. Additionally, or in the alternative, increased wear on the inner surface 44 may increase blowby of the fuel 20, the air 18, and/or the combustion products 78 past the top annular ring 58 or additional annular rings 62.

An anti-polishing ring at the top portion 92 of the cylinder liner 42 that extends radially inward toward the piston 24 may interact with the top land 54 to remove deposits from the second surface 122. The top land 54 of a piston 24 utilized with an anti-polishing ring is smaller (e.g., smaller diameter) for a given cylinder liner 42 than the top land 54 of a piston 24 with the given cylinder liner 42 utilized as described herein without an anti-polishing ring. The smaller top land 54 utilized with piston assemblies 40 having an anti-polishing ring increases the gap 80 between the second surface 122 of the piston 24 and the inner annular wall 44 of the cylinder liner 42. The greater gap 80 with the anti-polishing ring may increase the crevice volume and reduce engine efficiency relative to the embodiments of piston assemblies 40 described herein without anti-polishing rings. Moreover, piston assemblies 40 having an anti-polishing ring may have increased temperatures of the top land 54 and the cylinder liner 42 relative to piston assemblies 40 without an anti-polishing ring. Piston assemblies 40 with lower temperatures of the top land 54 and the cylinder liner may have reduced emissions, increased fatigue life of the piston 24, increased usable life of lubricants, and less frequent lubricant change intervals, or any combination thereof.

In some embodiments, the first surface 120 of the top portion 92 has a first surface finish that promotes the formation of carbon deposits on the top portion 92 relative to the top land 54 without any significant effect on the crevice volume of the combustion chamber 14. That is, whereas a "macro" surface finish on the first surface 120 may increase the crevice volume, embodiments of the first surface finish as described herein include a "micro" surface finish that has a substantially insignificant effect on the crevice volume relative to the clearances of the TTL design. For example, a roughness average (Ra) of the first surface finish of the first surface 120 is less than the TTL clearance (e.g., approximately 25 μm) during operation of the engine 12. Carbon deposits on the first surface 120 of the top portion 92 may extend at least partially across the gap 80 to scrape or remove carbon deposits that may form on the second surface 122 of the top land 54 of the piston 24. As may be appreciated, a surface finish may be defined by at least a surface roughness parameter and a waviness parameter, where the surface roughness parameter is a measure of the finely spaced irregularities of the surface, and the waviness parameter is a measure of surface irregularities with a spacing greater than that of the surface roughness parameter over a characteristic length. The surface roughness parameters discussed herein are roughness average (Ra) parameters. Ra is a parameter that corresponds to an arithmetic average of absolute values along a profile. The surface waviness parameters discussed herein are total waviness (Wt) parameters, where Wt is the sum of the largest profile peak height and the largest profile valley depth of the profile. As may be appreciated, Wt and Ra may be specified across a characteristic length, such as approximately 0.5, 0.8, or 1.0 mm. The roughness average $Ra_1$ of the first surface 120 may be greater than approximately 1, 2, 3, 4, 5, 10, 15, or 20 μm. In some embodiments, $Ra_1$ of the first surface 120 may be less than approximately 25 μm, such as approximately 20 μm. The Wt of the first surface may be less than approximately 0.1, 0.05, or 0.03 mm. For example, the first surface finish may have a roughness average $Ra_1$ greater than approximately 1 μm, and a total waviness Wt less than approximately 0.1 mm. It may be appreciated that a "micro" surface finish includes, but is not limited, to embodiments of the first surface 120 with $Ra_1$ less than 25 μm and the Wt less than 0.1 mm do not appreciably increase the crevice volume of the piston assembly 40. In some embodiments, the first surface finish of the first surface 120 may be formed by a process that includes, but is not limited to, drilling, milling, boring, broaching, reaming, grinding, honing, electropolishing, polishing, or lapping, or any combination thereof.

In some embodiments, the radial clearance of the TTL design of the piston assembly 40 may reduce the formation of carbon deposits on the top portion 92 and the top land 54. However, where the gap 80 may increase due to a bore distortion during operation of the engine 12, carbon deposits that form on the first surface 120 of the top portion 92 may inhibit the formation of carbon deposits on the second surface 122 of the top land 54. Reducing the formation of carbon deposits on the second surface 122 of the top land 54 may reduce wear on the inner wall 44, increase the longevity of the seal between the piston 24 and the cylinder liner 42, maintain the temperature of the top land 54 and the cylinder liner 42 within a desired operating temperature range (e.g., less than 250° C.), or any combination thereof. Increasing the longevity of the seal and/or reducing wear of the piston 24 or the cylinder liner 42 may decrease downtime associated with maintenance intervals, thereby enabling the engine 12 to continue providing power to the load 28 for a longer duration. Carbon deposit formation may increase with increased temperatures of the components (e.g., piston 24, cylinder liner 42). Accordingly, decreasing the formation of carbon deposits on the second surface 122 of the top land 54 may increase the heat transfer from the piston 24 to the cylinder liner 42, thereby decreasing the temperature of the top land 54 and further decreasing the likelihood of carbon deposit formation on the second surface of the top land 54.

In some embodiments, a second surface finish of the second surface 122 of the top land 54 is configured to inhibit the formation of carbon deposits on the top land 54. The roughness average ($Ra_2$) of the second surface 122 of the top land 54 may be less than 2, 1, 0.8, 0.5, or 0.3 μm. In some embodiments, the second surface finish of the second surface 122 may be formed by a process that includes, but is not limited to, drilling, milling, boring, broaching, reaming, grinding, honing, electropolishing, polishing, or lapping, or any combination thereof. Additionally, or in the alternative, a coating may be applied to the top land 54 with a roughness average greater than 2 μm, such that $Ra_2$ of the second surface 122 with the applied coating is less than approximately 2, 1, 0.8, 0.5, or 0.3 μm. Coatings may include, but are not limited to, chrome, graphite, molybdenum, cast iron, and silicon, among others. When the surface finish of the second surface 122 of the top land 54 is more smooth than the first surface 120 of the top portion 92 of the cylinder liner 42 (e.g., $Ra_2<Ra_1$), carbon deposits are more likely to be retained on the first surface 120 of the top portion 92 than on second surface 122 of the top land 54. That is, the surface roughness of the first surface 120 may be a better mechanical anchor that retains the carbon deposits, and the surface roughness of the second surface 122 may be a poor mechanical anchor for retaining carbon deposits. In some embodiments, a difference between the roughness average parameter $Ra_1$ of the first surface 120 and the roughness average parameter $Ra_2$ of the second surface 122 may be greater than a difference value. The difference value may be approximately 0.5, 0.7, 1, 2, 3, 4, 5 μm or more. In some embodiments, $Ra_1$ may be greater than $Ra_2$ by a factor of 2, 3, 4, 5, 6, 7, 8, 9, 10 or more. A greater difference between $Ra_1$ and $Ra_2$ may increase the probability that any carbon deposits formed in the piston assembly 40 are formed on the first surface 120 of the top portion 92 of the cylinder liner 42.

Below a top ring reversal 124 of the cylinder liner 42, a third surface finish of the travel portion 90 of the inner wall 44 may have a roughness average ($Ra_3$) less than approximately 1, 0.8, or 0.5 μm. As may be appreciated, the top ring reversal 124 of the cylinder liner 42 is radially opposite to the bottom of the top land 54 at the top dead center position. Accordingly, the top portion 92 of the cylinder liner 42 may be defined as the portion above the top ring reversal 124 in the axial direction 48. The roughness average $Ra_3$ may be less than (e.g., more smooth) than the roughness average $Ra_1$, thereby inhibiting the formation of carbon deposits on the travel portion 90 of the inner wall 44. In some embodiments, the roughness average $Ra_2$ of the second surface 122 of the top land 54 may be approximately equal to or less than the roughness average $Ra_3$ of the travel portion 90 of the inner wall 44. For example, the roughness average $Ra_3$ of the travel portion 90 may be approximately 0, 10, 25, 50, 100, 200, 300, or 400 percent greater than the roughness average $Ra_2$ of the second surface 122. The third surface finish of the travel portion 90 of the inner wall 44 may be formed by a process that includes, but is not limited to, drilling, milling, boring, broaching, reaming, grinding, honing (e.g., plateau honing), electropolishing, polishing, or lapping, or any combination thereof.

Figure 4:
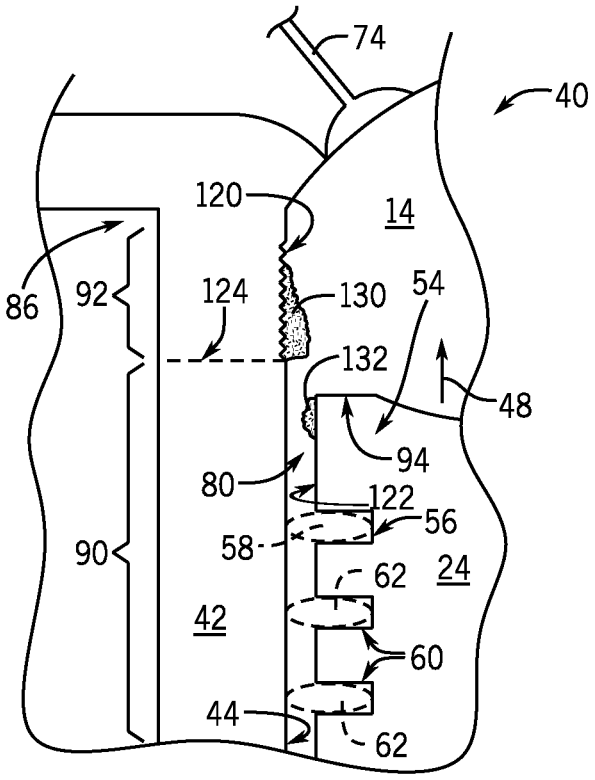
FIG. 4 is a partial cross-sectional view of an embodiment of the piston and the cylinder liner of the engine, taken within line 3-3 of FIG. 2.

FIG. 4 is a partial cross-sectional view of the piston 24 and cylinder liner 42 of the engine 12, taken within line 3-3 of FIG. 2. FIG. 4 illustrates the piston 24 moving in the axial direction 48 towards the top dead center position. First retained deposits 130 on the first surface 120 of the top portion 92 of the cylinder liner 42 extend into the annular gap 80 between the piston 24 and the cylinder liner 42. As the piston 24 moves towards the top dead center position, the first retained deposits 130 on the first surface 120 may interact with second retained deposits 132 on the second surface 122 of the top land 54 of the piston 24. The first surface finish of the first surface 120 anchors the first retained deposits 130 to the top portion 92 better than the second surface finish of the second surface 122 anchors the second retained deposits 132 to the top land 54 of the piston 24. Accordingly, the first retained deposits 130 on the top portion 92 may remove more of the second retained deposits 132 from the top land 54 than the second retained deposits 132 remove of the first retained deposits 130 from the top portion 92. Thus, the top land 54 of the piston 24 is cleaned by the first retained deposits 130 on the first surface 120, thereby reducing friction between the second surface 122 of the top land 54 and the travel portion 90 of the cylinder liner 42. In some embodiments, the first surface 120 may accumulate deposits at a faster rate than the second surface 122 based at least in part on the collection and holding of more lubricant (e.g., oil) by the first surface finish of the first surface 120 than the second surface finish of the second surface 122. The retained lubricant may coke during combustion, thereby forming deposits 130.

Technical effects of the embodiments discussed herein include reducing the crevice volume and reducing the formation of carbon deposits in the combustion chamber during operation of the engine. Additionally, or in the alternative, technical effects of the embodiments discussed herein include reducing the temperature of the piston, improving combustion efficiency, reducing oil consumption, reducing wear of the cylinder liner, reducing blowby, and increasing the longevity of seal rings about the piston, or any combination thereof. The rougher surface finish of the top portion of the cylinder liner relative to the surface finish of the top land increases the likelihood of deposit formation on the top portion of the cylinder liner. Additionally, to the extent that carbon deposits may form on the cylinder liner and the piston, the rougher surface finish of the top portion of the cylinder liner relative to the surface finish of the top land may cause retained deposits on the top portion to remove deposits from the top land of the piston during reciprocating movement of the piston within the cylinder liner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A reciprocating engine, comprising:

a cylinder liner having an inner wall and extending around a cavity, wherein the inner wall comprises a first axial end, a second axial end, a piston travel portion, and a top portion, wherein the top portion is nearer to the first axial end of the cylinder liner than to the second axial end of the cylinder liner, the top portion comprises a first surface finish, the first surface finish comprises a first roughness ($Ra_1$) greater than approximately 2 μm and a total waviness (Wt) less than approximately 0.1 mm, and $Ra_1$ and Wt are based on a characteristic length of approximately 0.8 mm; and a piston disposed within the cavity and configured to move in a reciprocating manner within the cylinder liner, wherein the piston comprises a top land configured to be radially opposite the top portion of the inner wall of the cylinder liner when the piston is at a top dead center position.

2. The reciprocating engine of claim 1, wherein $Ra_1$ is greater than approximately 5 μm.

3. The reciprocating engine of claim 1, wherein $Ra_1$ is less than approximately 25 μm.

4. The reciprocating engine of claim 1, wherein Wt is less than approximately 0.05 mm.

5. The reciprocating engine of claim 1, wherein a second surface finish of the top land of the piston comprises a second roughness average ($Ra_2$) less than approximately 2 μm, $Ra_2$ is less than $Ra_1$, and $Ra_2$ is based on the characteristic length of approximately 0.8 mm.

6. The reciprocating engine of claim 1, wherein the top land of the piston comprises a second surface finish, the second surface finish comprises a second roughness average ($Ra_2$), and $Ra_1$ of the first surface finish of the top portion of the inner wall is at least two times greater than $Ra_2$.

7. The reciprocating engine of claim 1, wherein the top land of the piston comprises a second surface finish, the second surface finish comprises second roughness average ($Ra_2$), and a difference between $Ra_1$ and $Ra_2$ is greater than approximately 0.5 μm.

8. The reciprocating engine of claim 1, wherein the top portion comprises a first diameter, the piston travel portion comprises a second diameter, and the first diameter is equal to the second diameter.

9. The reciprocating engine of claim 1, wherein the cylinder liner comprises a first radius at the top portion of the inner wall, the piston comprises a second radius at the top land, and a radial clearance between the first radius and the second radius during operation of the reciprocating engine is less than approximately 25 μm.

10. The reciprocating engine of claim 1, wherein the cylinder liner comprises a first radius at the top portion of the inner wall, the piston comprises a second radius at the top land, a clearance ratio between the first radius and the second radius is less than approximately 0.5% of a bore diameter of the top portion of the inner wall at room temperature, and the bore diameter comprises twice the first radius.

11. The reciprocating engine of claim 1, wherein the first surface finish is configured to retain carbon deposits at the top portion of the inner wall during operation of the reciprocating engine, and the retained carbon deposits at the top portion are configured to reduce carbon deposits at the top land without an anti-polishing ring.

12. A reciprocating engine, comprising:

a cylinder liner having an inner wall and extending around a cavity, wherein the cylinder liner comprises a first radius at a top portion of the inner wall of the cylinder liner, and the top portion comprises a first surface finish having a first roughness average ($Ra_1$) and a total waviness (Wt) less than approximately 0.1 mm; and a piston disposed within the cavity and configured to move in a reciprocating manner within the cylinder liner, wherein the piston comprises:

at least one annular groove extending circumferentially about the piston; and a top land adjacent to a top annular groove of the at least one annular groove, wherein the top land comprises a second radius and a second surface finish, a radial clearance between the first radius and the second radius during operation of the reciprocating engine is less than approximately 25 μm, the second surface finish comprises a second roughness average ($Ra_2$) less than approximately 2 μm, $Ra_2$ is less than $Ra_1$, and $Ra_1$, Wt, and $Ra_2$ are based on a characteristic length of approximately 0.8 mm.

13. The reciprocating engine of claim 12, wherein $Ra_1$ of the top portion of the inner wall is at least two times greater than $Ra_2$ of the top land of the piston.

14. The reciprocating engine of claim 12, wherein the cylinder liner comprises a piston travel portion below the top portion, the top portion of the inner wall comprises a first diameter, the piston travel portion comprises a second diameter, and the first diameter is equal to the second diameter.

15. The reciprocating engine of claim 12, wherein a difference between $Ra_1$ and $Ra_2$ is greater than approximately 0.5 μm.

16. The reciprocating engine of claim 12, wherein $Ra_2$ is less than approximately 0.5 μm.

17. A reciprocating engine, comprising:

a cylinder liner having an inner wall and extending around a cavity, wherein the inner wall comprises a first axial end, a second axial end, a piston travel portion, and a top portion, wherein the cylinder liner comprises a first radius at the top portion of the inner wall, the top portion is nearer to the first axial end of the cylinder liner than to the second axial end of the cylinder liner, the top portion comprises a first surface finish, and the first surface finish comprises a first roughness average ($Ra_1$) greater than approximately 2 μm and a total waviness (Wt) less than approximately 0.1 mm; and a piston disposed within the cavity and configured to move in a reciprocating manner within the cylinder liner, wherein the piston comprises a top land configured to be radially opposite the top portion of the inner wall of the cylinder liner when the piston is at a top dead center position, the piston comprises a second radius at the top land, and the top land of the piston comprises a second surface finish having a second roughness average ($Ra_2$) less than $Ra_1$;

wherein a radial clearance between the first radius and the second radius during operation of the reciprocating engine is less than approximately 25 μm, a difference between $Ra_1$ and $Ra_2$ is greater than approximately 0.5 μm, and $Ra_1$, Wt, and $Ra_2$ are based on a characteristic length of approximately 0.8 mm.

18. The reciprocating engine of claim 17, wherein $Ra_1$ is greater than approximately 5 μm.

19. The reciprocating engine of claim 17, wherein the cylinder liner comprises a first radius at the top portion of the inner wall, the piston comprises a second radius at the top land, a clearance ratio between the first radius and the second radius is less than approximately 0.5% of a bore diameter of the top portion of the inner wall at room temperature, and the bore diameter comprises twice the first radius.

20. The reciprocating engine of claim 17, wherein $Ra_2$ is less than approximately 0.8 μm.

* * * * *